United States Patent [19]

Hainey

[11] Patent Number: 5,007,129

[45] Date of Patent: Apr. 16, 1991

[54] GOLFER'S CLEANING TOOL

[76] Inventor: Melvin F. Hainey, 10609 Pinehurst Dr., Austin, Tex. 78747

[21] Appl. No.: 364,899

[22] Filed: Jun. 12, 1989

[51] Int. Cl.[5] ..... A63B 57/00

[52] U.S. Cl. ..... 15/236.08; 30/155; 30/169; 273/32 B

[58] Field of Search ..... 15/236.08, 236.05, 236.01; 30/155, 156, 158, 169; 273/32 B

[56] References Cited

U.S. PATENT DOCUMENTS

| | | | |
|---|---|---|---|
| 1,228,409 | 6/1917 | Collings | 30/156 |
| 1,507,632 | 9/1924 | Taylor | 15/236 |
| 1,599,604 | 9/1926 | Welmore | 30/156 |
| 2,154,211 | 4/1939 | Madsen | 30/156 |
| 2,857,608 | 10/1958 | Schwartz | 15/111 |
| 3,047,896 | 8/1962 | Gunderson | 15/111 |
| 3,763,515 | 10/1973 | Voss | 15/105 |
| 4,086,678 | 5/1978 | Torr | 273/32 B |
| 4,200,948 | 5/1980 | Nesseth | 15/236.08 |
| 4,535,987 | 8/1985 | Dikoff | 273/32 B |
| 4,759,092 | 6/1988 | Duddy | 15/236.08 |

FOREIGN PATENT DOCUMENTS

| | | | |
|---|---|---|---|
| 406482 | 12/1924 | Fed. Rep. of Germany | 30/156 |

*Primary Examiner*—Edward L. Roberts

[57] ABSTRACT

A very small, smooth, hand-held pocket tool which opens like a pocket knife to expose a cleaning element, such as a short piece of hacksaw blade, which can be used to clean the grooves and faces of golf clubs and can also be used to roughen the grips of such clubs. The essence of the tool is that it is so small that golfers would not hesitate to carry it in their pocket during a round of golf, yet when open the part that shields the cleaning element acts as a handle making the tool quite large enough to be effective. The cleaning element can easily be replaced when dull.

2 Claims, 1 Drawing Sheet

GOLFER'S CLEANING TOOL

BACKGROUND-FIELD OF INVENTION

This invention relates to golf club cleaning tools, specifically to such hand-held tools which are used for cleaning the grooves in the face of the club.

BACKGROUND-DESCRIPTION OF PRIOR ART

The importance of clean grooves in a golf club face is perhaps best illustrated by the fact that the United States Golf Association has outlawed the use of square grooves for golfers on the professional tour starting in 1990. Square grooves represent an innovation in club design and were manufactured in quantity during 1988. The profile of the groove is square instead of the more normal V-groove. This slight change allows the golfer to put much more spin on the golf ball and makes the game easier to play.

Good golfers are well aware of the importance of clean grooves, and a number of devices have been proposed to take care of the problem. None have seemed to catch on commercially, probably because they are not easily carried in the pocket or they are simply not effective. U.S. Pat. No. 4,086,678 to Torr (1978) discloses a small, multi-pronged tool not suitable for pocket use because of the sharp cleaning prongs. Another multi-pronged tool is shown in U.S. Pat. No. 3,763,515 Voss (1973). Both suffer from the fact that uniform spacing is not required for club face grooves, and hence it is quite possible that the fixed prongs would not align with the grooves in the club face. Further, a much better cleaning job can be done by cleaning one groove at a time rather than trying to clean several at once. U.S. Pat. Nos. 2,857,608 Schwartz (1955) and 3,047,896 Gunderson (1960) both have single cleaning prongs, but neither is replaceable when it becomes dull, nor do they have shields which would allow the tools to be carried in one's pocket.

The above patents are typical of the art, they are either too bulky or have too many sharp edges to be carried in the pocket. Most are designed for a quick cleaning job rather than a thorough cleaning job. Yet, often a golfer has time on his hands while waiting to hit his shot. If he has a convenient pocket tool that has even a slight chance of making the next shot easier, he will use it. But if he has to walk over to his golf cart or rummage through his golf bag to find the tool, he will usually not take the trouble.

An earlier invention, U.S. Pat. No. 1,507,632 Taylor (1922), has multiple cleaning prongs, or teeth, and although it is nice and small, it has a screwdriver tip on one end which could damage a pocket. Further, this device would not work on the curved, or bulged, faces of the wooden clubs. Other multi-pronged groove cleaners suffer from this same disadvantage.

Hence, there doesn't appear to be any effective small cleaning tool that a golfer could carry in his pocket that would fit in with a few wooden tees, a small coin or two, and a ball mark repair tool that almost all golfers carry in their pocket during a round of golf.

OBJECTS AND ADVANTAGES

The objects and advantages of the present invention are:

(a) to provide a small tool with no sharp edges, about the size of a single wooden tee, to be carried in a golfer's pocket so that it will always be available for cleaning the grooves in a club head.

(b) to provide a tool that has a universally available cleaning element, such as a piece of common hacksaw blade, that can easily be replaced when dull.

(c) to provide a tool, quite small, that can be opened like a pocket knife so that in use it is comparable to a much larger tool.

(d) to provide a tool with a novel opening feature suitable for a tool of such small size.

(e) to provide a tool that can also be used as a rougheener for the grips of a golf club.

(f) to provide a tool that has the above features and yet is easy to manufacture and extremely long-lived.

A further object and advantage is that the part of the tool that serves as a shield for the sharp cleaning edges when the tool is closed also serves as a handle when it is open, effecting economy and simplicity of design.

DRAWING FIGURES

Figure 3:
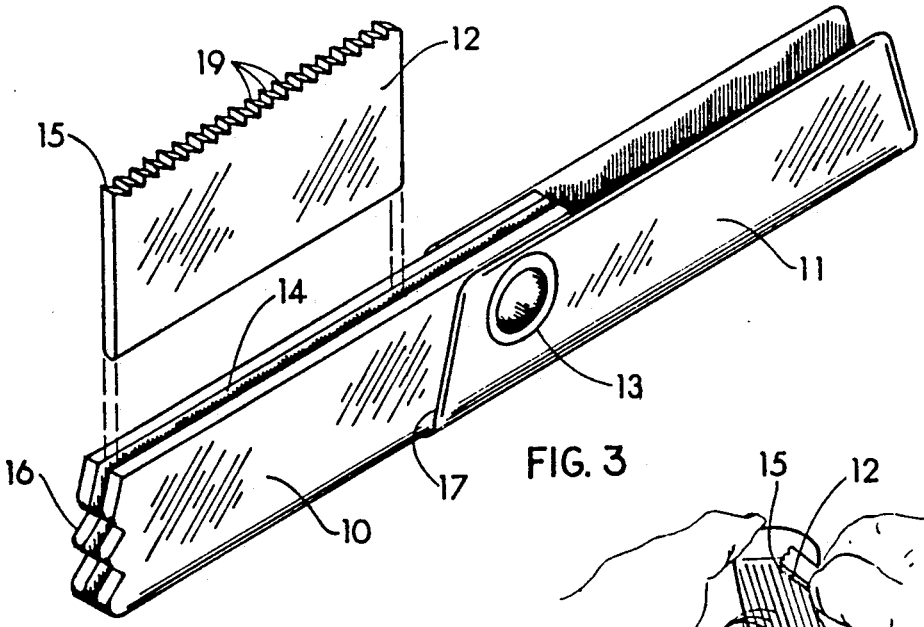

FIG. 3 shows the basic elements of the invention: the blade holder 10, the handle/shield 11, and the replaceable hacksaw blade 12.

Figure 4:
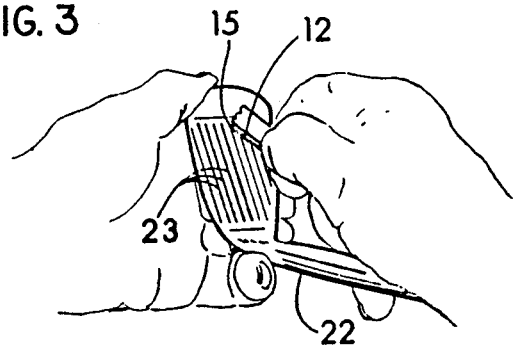
Figure 5:
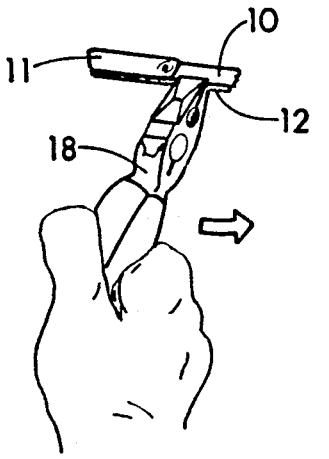
Figure 6:
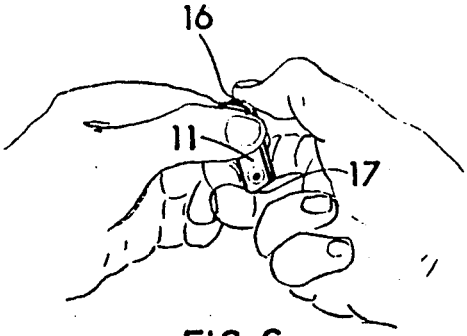

FIGS. 4, 5, and 6 show, respectively, one use of the tool, blade replacement, and the way to open the tool.

DESCRIPTION-FIGS. 1 TO 3

Figure 1:
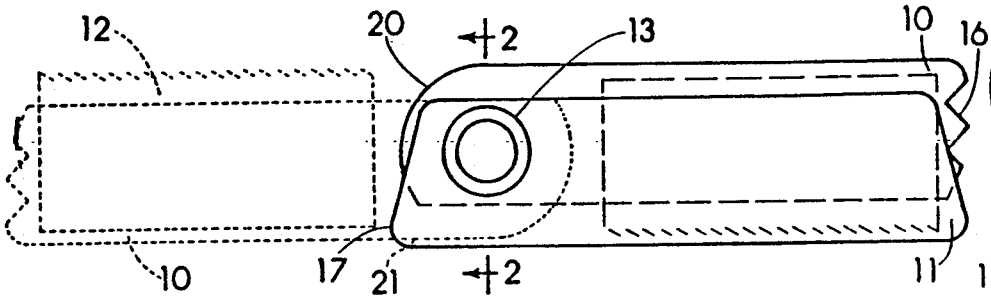
FIG. 1 shows the device in a closed position with a ghosted illustration of the open position.

One embodiment of the present invention is shown pictorially in FIG. 3. The main elements of the device are the blade holder 10, the handle/shield 11, and the hacksaw blade 12. The blade holder is a piece of metal or other suitably strong material bent into a narrow U-shape so that the hacksaw blade 12 can just be forced into the groove 14 where it will be securely fixed. The handle/shield 11 is a similar somewhat thinner piece of metal or other strong material bent into a U-shape that will just accommodate the blade holder. The two pieces are hinged together with an eyelet so that they may rotate with respect to each other. As shown in FIG. 1, the end of the blade holder 10 is curved at 20 so that it can rotate 180 degrees until it is stopped by the handle/shield 11 at 21.

Figure 2:
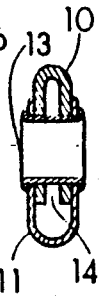
FIG. 2 is a sectional view showing the eyelet. The importance of this view will be made clear in the detailed discussion.

FIG. 2 shows how the eyelet 13 holds together the blade holder 10 and the handle/shield 11. It is important to note the air gap at 14. This shows that the blade holder 10 is somewhat spring-loaded against the retaining eyelet. It is this arrangement that allows the two parts, the blade holder 10 and the handle/shield 11 to rotate smoothly with respect to each other and retain the proper amount of friction for extended periods of time. If the parts are made from stainless steel the device should easily last a lifetime.

Operation-FIGS. 4 to 6

FIG. 4 shows the basic use of the tool; that is, cleaning the grooves of a golf club 22. For this use the plane of the hacksaw blade is held at about a 45 degree angle to the club face and the single end tooth 15 of the blade 12 is drawn along the grooves 23 one at a time. Note that the back of the tooth is more than adequate to do the cleaning job. It is not the intent to remove metal from the club face; however, this operation will brighten the top edge of the grooves so that in the normal address position for hitting a golf shot it will usually be apparent that the grooves are clean by the reflected glint from this edge. Since golf is a highly psychological game, this is an important consideration, and the sight of clean grooves can add a significant positive factor to the execution of the shot. Most golf club irons are made of a fairly soft metal because it gives a better feel to the shot. A mild steel or something like beryllium-copper is commonly used, and a hacksaw blade just happens to be about the right hardness to make an excellent cleaning tool. The single cleaning tooth will stay sharp for many months of use, but when it does get dull it is easily replaced as described below.

Usually mud on the face of the club outside of the grooves is not a problem, but should the flat portion of the club need cleaning, this may be done by holding the hacksaw blade 12 at right angles to the face and gently brushing it with all of the teeth 19 of the blade. In the same manner all of the teeth of the blade may be used to roughen the grips of the club. After some use golf club grips often become somewhat slick. Heavy sandpaper is sometimes used to roughen the surface of the grips, but this has the disadvantage of removing a considerable amount of the grip material, not a desirable result. Brushing the hacksaw blade sideways along the length of the grip will roughen it nicely with very little abrasion.

FIG. 5 illustrates a simple way to remove the hacksaw blade when it becomes dull. This will not be necessary very often. The handle/shield 11 is held in the left hand while the blade 12 is gripped with pliers 18 and twisted out of the blade holder 10 as shown. Hacksaw blades are very brittle, and it is easy to break off a small piece with a few back and forth bends. The new piece can be easily tapped into place with a small hammer.

A very easy way to open the tool is shown in FIG. 6. The handle/shield 11 is gripped with the thumb and index finger of the left hand near the non-pivoting end. The corner 17 of the handle/shield 11 is placed on the middle finger of the right hand and the pad of the thumb can now apply torque to the notched end 16 of the blade holder. Use of the very end of the blade holder provides the maximum amount of leverage for opening the tool. Since the tool is so small, this is important. Short blades on a knife are always difficult to open because of such lack of leverage. Further, it is easier to use the pad of the thumb than it is to use the thumb nail. The device is closed like a pocket knife and is held in the closed position by friction at the eyelet 13 and at the sides of the handle/shield 11.

SUMMARY, RAMIFICATIONS, AND SCOPE

A golf club tool is described that is small and smooth and can easily be carried in the pocket. It opens like a pocket knife to expose a cleaning element, such as a piece of hacksaw blade, which may be used to clean the grooves and faces of golf clubs and may also be used to roughen golf club grips. The structure that shields the cleaning element in the closed position becomes an effective handle when the tool is opened. The cleaning element may be easily replaced when dull.

For clarity a single embodiment of the device is described above. Other forms are possible. For example, the handle/shield may be made of high-impact plastic suitable for imprinting company logos, trademarks or such. Imprints could, of course, be made on a metal handle/shield also. The notched end of the blade holder could just as well be configured with a small round knob, just as long as the thumb pad can get a grip on it.

Thus the scope of this invention should be determined by the appended claims, not the specific examples given.

I claim:

1. A golfer's tool comprising a first rectangular member formed longitudinally into a U-shaped holder having a first and second end and adapted to receive a scraping element, a scraping element mounted in said holder, said scraping element comprising an elongated blade having a plurality of teeth on one edge thereof extending between ends of said blade with one tooth closely adjacent one end of said blade, said one end of said blade being positioned closely adjacent said first end of said holder, a second rectangular member formed longitudinally into a U-shaped handle/shield, means pivotally mounting said second end of said first member in one end of said second member so that said first member can be pivoted into said second member to a closed position to position said edge of said blade within said second member with the first end of said first member extruding beyond the other end of said second member, means defining a gripping surface on the first end of said first member for engagement by a finger to pivot said first member from a closed position to an open position whereby said one tooth can be used to clean grooves in the face of a golf club and the plurality of teeth can be used for roughening the grip of a golf club.

2. The golfer's tool as defined in claim 1 wherein said means pivotally mounting said first member in said second member comprises an eyelet type hinging element, said eyelet providing a slight spring compression on the U-shaped handle/shield against the U-shaped holder to insure opening and closing friction between said handle/shield and said holder.

* * * * *